US011293131B2

(12) United States Patent
Hoppe et al.

(10) Patent No.: US 11,293,131 B2
(45) Date of Patent: Apr. 5, 2022

(54) APPLIANCE WITH HAND HELD STEAM ACCESSORY

(71) Applicant: Midea Group Co., Ltd., Foshan (CN)

(72) Inventors: Christopher Hoppe, Louisville, KY (US); Daniel Trice, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 889 days.

(21) Appl. No.: 15/941,845

(22) Filed: Mar. 30, 2018

(65) Prior Publication Data

US 2019/0301072 A1 Oct. 3, 2019

(51) Int. Cl.
*D06F 39/00* (2020.01)
*D06F 105/40* (2020.01)
*D06F 105/46* (2020.01)

(52) U.S. Cl.
CPC ..... *D06F 39/008* (2013.01); *D06F 2105/40* (2020.02); *D06F 2105/46* (2020.02)

(58) Field of Classification Search
CPC ..... D06F 75/12; D06F 33/00; D06F 39/008; D06F 87/00; D06F 39/088; D06F 73/00; D06F 2105/40; D06F 75/10; D06F 75/20
USPC ..... 68/4, 5 R, 5 C, 13 R, 222, 207, 12.02
See application file for complete search history.

(56) References Cited

U.S. PATENT DOCUMENTS 3,559,427 A * 2/1971 Baker ..... F22B 1/284 68/222
5,609,047 A * 3/1997 Hellman, Jr ..... D06F 73/00 68/222
7,513,132 B2 4/2009 Wright et al.
7,562,543 B2 * 7/2009 Kendall ..... D06F 95/002 312/228.1
7,587,917 B2 * 9/2009 Gilboe ..... D06F 29/00 134/137
7,624,600 B2 * 12/2009 Sunshine ..... D06F 43/088 68/3 R
7,814,770 B2 * 10/2010 Jeon ..... D06F 69/00 66/200
8,322,169 B2 * 12/2012 Kendall ..... D06F 29/00 68/205 R
8,369,695 B2 2/2013 Lee et al.
(Continued)

FOREIGN PATENT DOCUMENTS

CN 101273164 A 9/2008
CN 101290144 A 10/2008
(Continued)

OTHER PUBLICATIONS

Dong et al., "Inside and outside belt cleaning device of lampblack absorber", Feb. 2016, CN 205014445—Machine Translation (Year: 2016).*
(Continued)

*Primary Examiner* — Michael E Barr
*Assistant Examiner* — Thomas Bucci
(74) *Attorney, Agent, or Firm* — Middleton Reutlinger

(57) ABSTRACT

A major appliance such as a laundry washing machine, a dryer, a cooking appliance or a dishwasher includes an internal steam generator fluidly coupled to a hand held steam accessory that is configured to be manually operated to perform a steaming operation external to the cabinet.

13 Claims, 4 Drawing Sheets

(56) References Cited

U.S. PATENT DOCUMENTS

| | | | | |
|---|---|---|---|---|
| 8,549,887 | B2 * | 10/2013 | Reid | D06F 19/00 68/3 R |
| 8,819,959 | B2 | 9/2014 | Klug et al. | |
| 2004/0134237 | A1 | 7/2004 | Sunshine et al. | |
| 2004/0163184 | A1 * | 8/2004 | Waldron | D06F 73/02 68/5 R |
| 2006/0156763 | A1 * | 7/2006 | Vecchi | D06F 39/14 68/13 A |
| 2009/0183532 | A1 | 7/2009 | Kim et al. | |
| 2010/0005681 | A1 | 1/2010 | Jo et al. | |
| 2010/0058813 | A1 * | 3/2010 | Moon | D06F 73/02 68/6 |
| 2011/0132043 | A1 | 6/2011 | Kim | |
| 2012/0005915 | A1 | 1/2012 | Song et al. | |
| 2013/0047346 | A1 * | 2/2013 | Im | D06F 39/008 8/137 |
| 2013/0117944 | A1 * | 5/2013 | Moon | D06F 58/44 68/5 R |
| 2015/0167229 | A1 | 6/2015 | Ahn et al. | |
| 2016/0102425 | A1 * | 4/2016 | Scheckelhoff | D06F 29/00 68/13 R |
| 2016/0122935 | A1 * | 5/2016 | Seo | D06F 39/088 68/207 |
| 2016/0355965 | A1 * | 12/2016 | Ye | D06F 58/203 |
| 2017/0037557 | A1 | 2/2017 | Doyle et al. | |
| 2018/0142391 | A1 * | 5/2018 | Hombroek | D06F 43/002 |

FOREIGN PATENT DOCUMENTS

| | | | | |
|---|---|---|---|---|
| CN | 201218543 | Y | | 4/2009 |
| CN | 202477617 | U | | 10/2012 |
| CN | 103054436 | A | | 4/2013 |
| CN | 103831265 | A | | 6/2014 |
| CN | 205014445 | U | * | 2/2016 |
| CN | 205014445 | U | | 2/2016 |
| CN | 206337406 | U | * | 7/2017 |
| CN | 206337406 | U | | 7/2017 |
| CN | 206593170 | U | | 10/2017 |
| EP | 0982429 | B1 | | 9/2003 |
| WO | 2007012721 | A2 | | 2/2007 |
| WO | 2011020700 | A1 | | 2/2011 |
| WO | 2013183258 | A1 | | 12/2013 |

OTHER PUBLICATIONS

Zhong et al., "Take steam to spout outward and hang washing machine of boiling hot function", Jul. 2017, CN 206337406—Machine Translation (Year: 2017).*

International Search Report and Written Opinion issued in Application No. PCT/CN2019/078026 dated Jun. 13, 2019.

The State Intellectual Property Office of People's Republic of China, Office Action issued in Application No. 201980014935.6, dated Mar. 10, 2021.

The State Intellectual Property Office of People's Republic of China, Office Action issued in Application No. 201980014935.6, dated Aug. 4, 2021, 14 pages.

* cited by examiner

APPLIANCE WITH HAND HELD STEAM ACCESSORY

BACKGROUND

Steam is commonly used to treat clothing for the purpose of wrinkle removal, odor removal and general cleaning. Many irons and presses, for example, are capable of generating steam, and various portable or hand held steam appliances exist for use in wrinkle removal as an alternative to ironing. These various portable appliances often have relatively limited steam generating capability, and may take several minutes to generate steam after being initially turned on. In addition, these appliances often require that a user manually fill a reservoir with water in order to generate steam.

Some major appliances, e.g., dishwashers and laundry washing machines and dryers, may also incorporate internal steam generators for use in treating dishes or clothing with steam when performing wash or dry cycles. These appliances are generally coupled to a household water line, and may be provided with higher output heating elements than portable or hand held steam appliances. However, the steam generated by these appliances is generally only used internally within the appliances and in connection with the primary operating cycles of the appliances.

SUMMARY

The herein-described embodiments address these and other problems associated with the art by providing a major appliance with an internal steam generator and a hand held steam accessory coupled to the internal steam generator for use in providing steam for performing a manual operation separate from the primary operational purpose of the appliance. In some embodiments, for example, a laundry washing machine or dryer may be provided with an internal steam generator for use in treating clothing during a wash or dry cycle of the appliance, along with a hand held steam accessory that receives steam from the internal steam generator and that is usable externally from the appliance, e.g., to remove wrinkles from clothing, among other operations.

Therefore, consistent with one aspect of the invention, a laundry treatment machine may include a cabinet, a water inlet coupled to the cabinet and configured to fluidly couple to an external water supply, a rotatable drum disposed within the cabinet, a drive system configured to rotate the drum, a steam generator disposed within the cabinet, the steam generator fluidly coupled to the water inlet, a hand held steam accessory including a steam dispensing head and a flexible hose fluidly coupled to the steam generator, the hand held steam accessory configured to be manually operated to perform a steaming operation external to the cabinet, and a controller coupled to the drive system and the steam generator, the controller configured to control the drive system during a primary laundry treatment cycle, to selectively actuate the steam generator to generate steam for use in the primary laundry treatment cycle, and to selectively actuate the steam generator to generate steam for use in the steaming operation with the hand held steam accessory.

In some embodiments, the primary laundry treatment cycle is a wash cycle. Also, in some embodiments, the primary laundry treatment cycle is a dry cycle.

Consistent with another aspect of the invention, a major appliance may include a cabinet, a major appliance component, a steam generator disposed within the cabinet, the steam generator configured to fluidly couple to a water supply, a controller coupled to the major appliance component and the steam generator, the controller configured to control the major appliance component to perform a primary operational cycle of the major appliance, the controller further configured to selectively actuate the steam generator to generate steam, and a hand held steam accessory fluidly coupled to the steam generator and configured to be manually operated to perform a steaming operation external to the cabinet.

In addition, in some embodiments, the major appliance is a laundry washing machine that includes a wash tub and a rotatable wash drum disposed in the wash tub, where the major appliance component includes a drive system configured to rotate the wash drum, and where the primary operational cycle of the major appliance is a wash cycle. In some embodiments, the major appliance is a laundry dryer that includes a rotatable drum, where the major appliance component includes a drive system configured to rotate the drum, and where the primary operational cycle of the major appliance is a dry cycle. Moreover, in some embodiments, the major appliance is a dishwasher that includes a wash tub, where the major appliance component includes a pump configured to circulate water in the wash tub, and where the primary operational cycle of the major appliance is a wash cycle.

Further, in some embodiments, the major appliance includes an oven, where the major appliance component includes a cooking element configured to supply heat to the oven, and where the primary operational cycle of the major appliance is a cooking cycle. In addition, in some embodiments, the major appliance includes a cooktop, where the major appliance component includes a cooktop burner, and where the primary operational cycle of the major appliance is a cooking cycle. Also, in some embodiments, the major appliance includes a refrigerator, where the major appliance component includes a compressor, and where the primary operational cycle of the major appliance is a cooling cycle.

Further, in some embodiments, the steam generator includes first and second outputs, the first output fluidly coupled to the hand held steam accessory, and the second output configured to output steam for use in the primary operational cycle of the major appliance, and where the controller is further configured to selectively actuate the steam generator to supply steam from the second output during the primary operational cycle of the major appliance.

In some embodiments, the major appliance is a laundry treatment appliance, where the controller is configured to selectively actuate the steam generator to steam laundry disposed within the cabinet, and where the steaming operation is an external laundry treatment operation. In addition, in some embodiments, the steaming operation is a surface cleaning operation for cleaning a surface of the major appliance. Moreover, in some embodiments, the hand held steam accessory includes a flexible hose and a steam dispensing head coupled to the flexible hose. Further, in some embodiments, the cabinet includes an accessory storage compartment for use in storing at least a portion of the hand held steam accessory. In some embodiments, the flexible hose is retractable into the accessory storage compartment. Further, in some embodiments, the flexible hose is fluidly coupled to the steam generator through a releasable fitting such that the flexible hose is detachable from the releasable fitting.

Some embodiments may also include a control panel, the control panel including a plurality of user controls, a first subset of the plurality of controls configured to control the controller to perform the primary operational cycle of the major appliance, and a second subset of the plurality of controls configured to control the controller to actuate the steam generator to supply steam to the hand held steam accessory. Some embodiments may further include a water inlet configured to couple to a residential water supply and a valve coupled intermediate the water inlet and the steam generator to control water flow to the steam generator.

Consistent with another aspect of the invention, a method of operating a major appliance that includes a controller disposed within a cabinet may include controlling a major appliance component of the major appliance to perform a primary operational cycle of the major appliance, and controlling a steam generator disposed within the cabinet and coupled to a water supply to generate and supply steam to a hand held steam accessory fluidly coupled to the steam generator for use in performing a manual steaming operation external to the cabinet.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
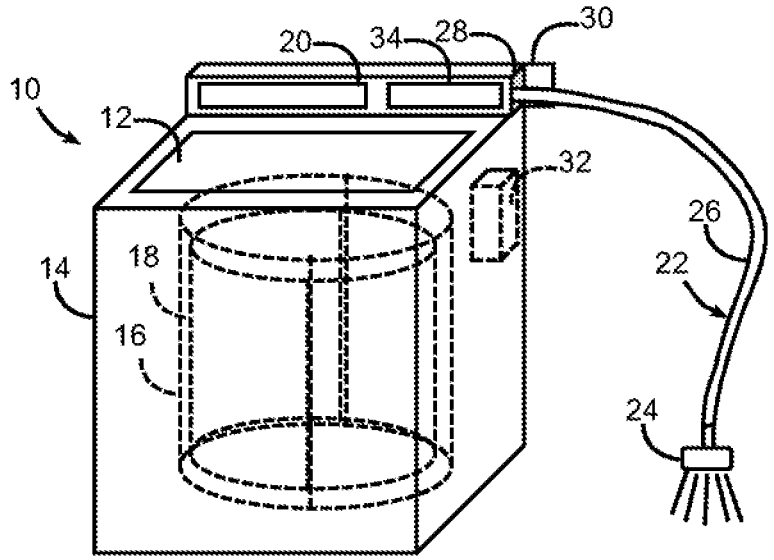
FIG. 1 is a perspective view of a top-load laundry washing machine consistent with some embodiments of the invention.

Embodiments consistent with the invention may be used to provide a hand held steam accessory for a major appliance such as a laundry washing machine, dryer, combination washer/dryer or other laundry treatment appliance; a dishwasher; a cooking appliance such as an oven (wall, countertop, over-the-range, etc.), range or cooktop; a refrigerator; or a vent hood, among others. A major appliance will be understood to be a residential-type appliance that is generally disposed within a fixed location in a household, as contrasted with small appliances that are generally portable and/or otherwise kept on a countertop or easily stored away in a cupboard.

The major appliance may include, for example, a cabinet that may vary considerably for different types of major appliances, e.g., cabinets used for washers, dryers, portable dishwashers, and freestanding ranges; insulated cases for refrigerators; support frames for undercounter dishwashers, drop-in cooktops, drop-in ranges or in-wall ovens; etc. The major appliance may also include one or more major appliance components that are generally controlled by a controller to perform a primary operational cycle of the major appliance. For example, for a laundry washing machine where the primary operational cycle is a wash cycle, major appliance components such as a drum drive system and a pump system may be includes, while for a laundry dryer where the primary operational cycle is a dry cycle, major appliance components such as a drum drive system, a heater and a fan may be included. For a dishwasher where the primary operational cycle is a wash cycle, major appliance components such as a pump system and a heater may be included.

Similarly, for a cooking appliance such as an oven, range or cooktop, and where the primary operational cycle is a cooking cycle, major appliance components may include various cooking or heating elements, e.g., oven cooking elements and/or cooktop burners. Moreover, for a refrigerator where the primary operational cycle is a cooling cycle, major appliance components may include one or more compressors.

In addition, in the illustrated embodiments, a major appliance may include a steam generator disposed within the cabinet of the major appliance and configured to fluidly couple to a water supply, and further capable of being selectively actuated by the controller to generate steam. The steam generator is further fluidly coupled to a hand held steam accessory to supply steam thereto, thereby enabling a user to manually operate the accessory to perform a steaming operation external to the cabinet of the major appliance. In addition, in some embodiments, the steam generator may also include two outputs, with one output used to provide steam to the hand held accessory, and another output used to provide steam for use in a primary operational cycle of the major appliance.

For example, for a laundry treatment machine such as a washer, dryer or combination washer/dryer, a steam generator may be used to generate steam for a laundry treatment cycle, e.g., to provide additional cleaning functionality and/or to release wrinkles in laundry within the laundry treatment machine. Similarly, for a dishwasher, a steam generator may be used to generate steam for a wash cycle and thereby treat dishes disposed within the dishwasher. It will be appreciated that steam may be used in a number of different applications and in other primary operational cycles of other major appliances, so the invention is not so limited.

A hand held steam accessory consistent with the invention is generally manually operated and fluidly coupled to the steam generator to perform a steaming operation external to the cabinet of the major appliance. In some instances, for example, the steaming operation may be an external laundry treatment operation to release wrinkles from clothing and other types of laundry. In some instances, the steaming operation may be a surface cleaning operation for cleaning a surface of the major appliance, e.g., a door, cabinet, housing, cooktop surface, etc. A steaming operation may also be used to clean internal components of an appliance, e.g., to clean an oven or other compartment, as well as to clean or otherwise steam treat other items.

As will become more apparent below, a hand held steam accessory may be configured in a number of different manners for different appliances and applications. For example, in some embodiments, a hand held steam accessory may include a flexible hose to convey steam and a steam dispensing head coupled to the flexible hose, and in some embodiments, the flexible hose and steam dispensing head may be removably coupled to one another, e.g., to enable different types of heads to be used for different purposes (e.g., to provide different sizes, to provide different steam flow rates, to provide bristles or other scrubbing utensils, etc.). A hand held steam accessory may also in some embodiments include one or more handles and/or one or more controls disposed proximate the head to facilitate manipulation and control by a user. Controls, for example, may be electronic in nature, e.g., to activate or deactivate a steam generator, or may be mechanical nature, e.g., to open or close a valve controlling the flow of steam from the head.

As will also be apparent below, in some embodiments a major appliance may include an accessory storage compartment for use in storing at least a portion of a hand held steam accessory, e.g., just a hose, both a hose and head, or even a hose and multiple heads. Further in some instances a hose may be retractable into the storage compartment, and in some instances a door may be used to cover the compartment. Further, in some embodiments a hand held steam accessory may be fluidly coupled to a steam generator through a releasable fitting such that the flexible hose is detachable from the releasable fitting. The releasable fitting may be disposed at a convenient location in some embodiments to facilitate attachment and removal of the hand held steam accessory.

A major appliance consistent with the invention may also include a control panel for interacting with a user as well as a controller for controlling the major appliance based upon user interaction with the control panel. The control panel, in some instances, may include a first subset of controls configured to control the controller to perform the primary operational cycle of the major appliance, and a second subset of controls configured to control the controller to actuate the steam generator to supply steam to the hand held steam accessory. In other instances, separate control panels or separate controls may be used to control the primary operational cycle and steaming operations of the major appliance.

A controller of the major appliance may also control both the primary operational cycle and steaming operations of the major appliance within the same control module. In other instances, however, a controller may distributed among multiple control modules, and as such different cycles and/or operations may be performed by different control modules or combinations of control modules.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry treatment machine 10, here a laundry washing machine, in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14 and including therein a rotatable drum 18. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 20 disposed on a backsplash and implementing a user interface for the washing machine, and it will be appreciated that in different washing machine designs, control panel 20 may include various types of input and/or output devices, including various knobs, buttons, lights, switches, textual and/or graphical displays, touch screens, etc. through which a user may configure one or more settings and start and stop a wash cycle.

Laundry treatment machine 10 also includes a hand held steam accessory 22 including a steam dispensing head 24 and a flexible hose 26, which may be permanently or removably coupled to one another (e.g., to enable different types of heads to be attached to flexible hose 26 for different types of steaming operations). In this embodiment, a storage compartment 28 is provided in cabinet 12 (e.g., within the backsplash), and at least flexible hose 26 is retractable into the storage compartment. The retraction may be manually-implemented, e.g., by pushing the hose into the compartment, while in other embodiments, automatic retraction may be supported, e.g., using mechanical or electromechanical retraction mechanisms. In addition, a door 30 may be provided on storage compartment 28 for aesthetic purposes. It will also be appreciated that storage compartment may be located at other locations within a major appliance and may be accessed in other manners. In other embodiments, a storage compartment may also be omitted.

Flexible hose 26 is in fluid communication with a steam generator 32, and in the illustrated implementation, a separate control panel 34 from control panel 20 is used to control hand held steam accessory 22. Control panel 34 may include a single on/off control in some embodiments, while in other embodiments, additional controls may be provided, e.g., to provide timed operation, to control temperature and/or flow rate, etc.

Figure 2:
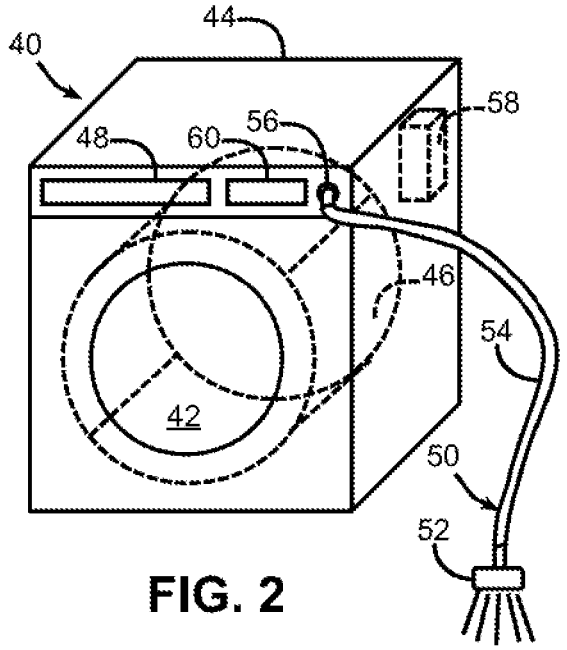
FIG. 2 is a perspective view of a laundry dryer consistent with some embodiments of the invention.

FIG. 2 illustrates another laundry treatment machine 40, here a front-load laundry dryer, that is also configured to support a hand held steaming accessory consistent with the invention. Machine 40 includes a front-mounted door 42 in a cabinet or housing 44 that provides access to a horizontally-oriented rotatable drum 46 housed within the cabinet or housing 44, and that has a control panel 48 positioned towards the front of the machine. In addition, machine 40 includes a hand held steam accessory 50 including a steam dispensing head 52 and a flexible hose 54, which may be permanently or removably coupled to one another (e.g., to enable different types of heads to be attached to flexible hose 54 for different types of steaming operations). In this embodiment, no storage compartment is provided, and instead a releasable fitting 56 is provided to enable the accessory 50 to be removed when not being used. The releasable fitting may be implemented using various types of fluid couplings, and quick release fittings may be used in some embodiments to enable a user to quickly attach or remove the accessory to or from the machine. A steam generator 58 is fluidly coupled to accessory 50 and control is provided by a separate control panel 60, although a single control panel could be used in other embodiments.

For both machines 10 of FIG. 1 and machine 40 of FIG. 2, the respective steam generators may be used to additionally provide steam for use in primary operational cycles of the machines, e.g., to steam clothing or other laundry being housed within and treated by the machine. In other embodiments, however, steam may not be provided for use in primary operational cycles, so the invention is not so limited.

Figure 3:
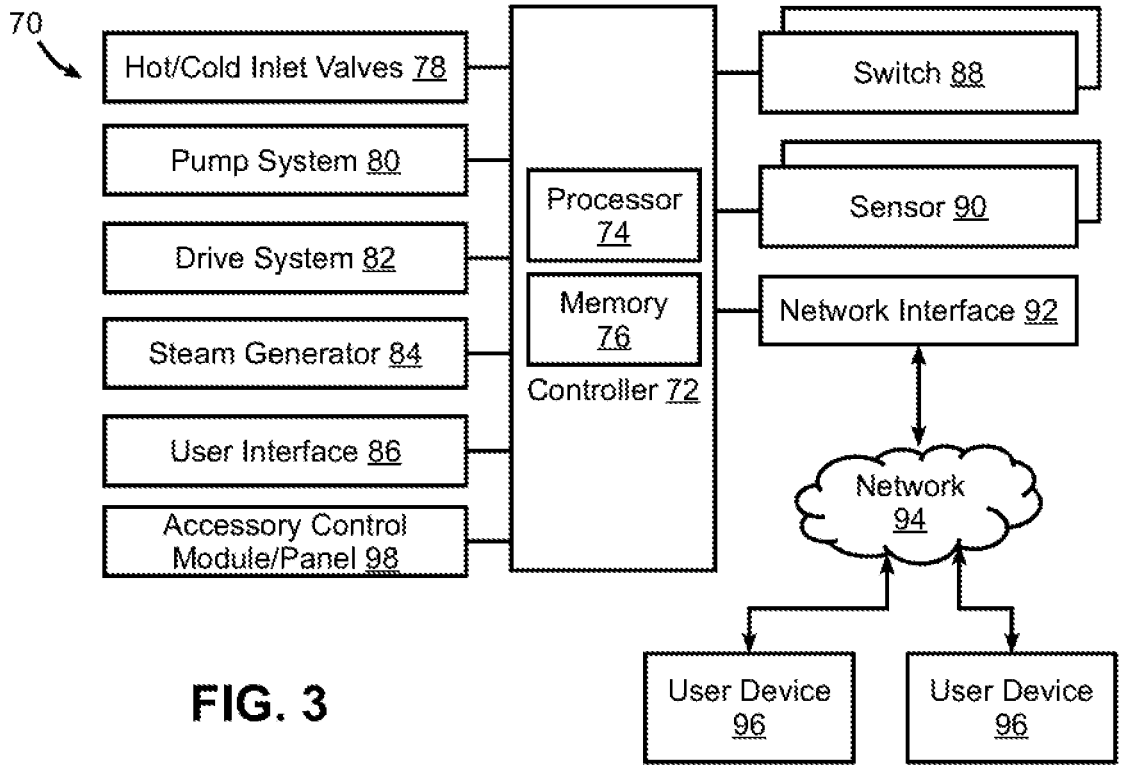
FIG. 3 is a block diagram of an example control system for a laundry washing machine consistent with some embodiments of the invention.
Figure 4:
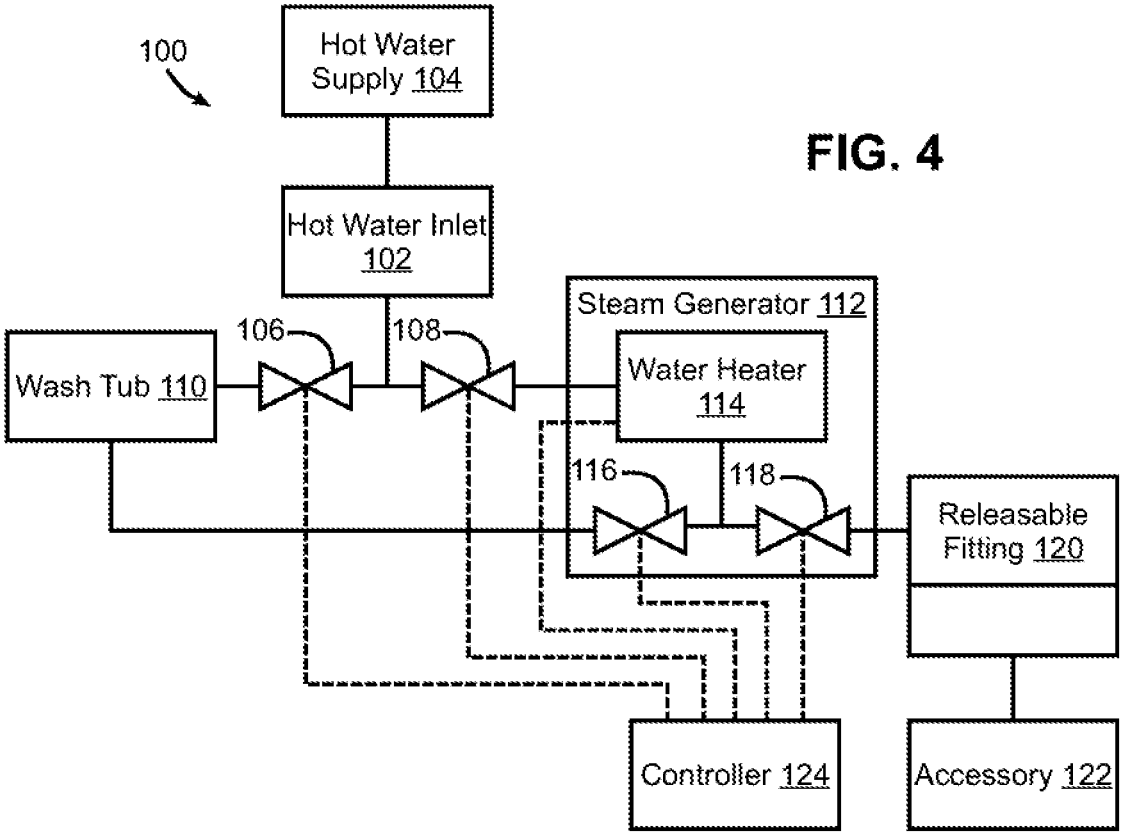
FIG. 4 is a block diagram of an example circuit diagram for a laundry washing machine consistent with some embodiments of the invention.

Now turning to FIG. 3, a major appliance consistent with the invention also generally includes one or more controllers configured to control the appliance, e.g., to perform one or more primary operational cycles. FIG. 3, for example, illustrates an example embodiment of a laundry washing machine 70 including a controller 72 that receives inputs from a number of components and drives a number of components in response thereto. Controller 72 may, for example, include one or more processors 74 and a memory 76 within which may be stored program code for execution by the one or more processors. The memory may be embedded in controller 72, but may also be considered to include volatile and/or non-volatile memories, cache memories, flash memories, programmable read-only memories, read-only memories, etc., as well as memory storage physically located elsewhere from controller 72, e.g., in a mass storage device or on a remote computer interfaced with controller 72.

As shown in FIG. 3, controller 72 may be interfaced with various major appliance components, including hot/cold inlet valves 78, a pump system 80 for pumping water and wash liquid out of a wash tub, and a drum drive system 82 for rotating the rotatable drum. Further, a steam generator 84 may be provided either for exclusive use by a hand held steam accessory or for use by such an accessory as well as in primary operational cycles of the machine. Moreover, controller 72 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user.

Controller 72 may also be interfaced with various additional switches 88 and sensors 90, e.g., to control various valves, solenoids, etc. and to sense various conditions or states for the appliance. In addition, in some embodiments, controller 72 may also be coupled to one or more network interfaces 92, e.g., for interfacing with external devices via wired and/or wireless networks such as Ethernet, Wi-Fi, Bluetooth, NFC, optical, cellular and other suitable networks, collectively represented in FIG. 3 at 94. Network 94 may incorporate in some embodiments a home automation network, and various communication protocols may be supported, including various types of home automation communication protocols. Network 94 may also be used to communicate between different components in appliance 70, as well as to various user devices 96 and/or to remote computers such as cloud-based systems.

In some embodiments, controller 72 may operate under the control of an operating system and may execute or otherwise rely upon various computer software applications, components, programs, objects, modules, data structures, etc. In addition, controller 72 may also incorporate hardware logic to implement some or all of the functionality disclosed herein. Further, in some embodiments, the sequences of operations performed by controller 72 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

In addition, controller 72 is also coupled to an accessory control module/panel 98, which is used to control the operation of a hand held steam accessory consistent with the invention. Control module/panel 98, for example, may include one or more controls to control the operation of an accessory, e.g., by controlling steam generator 84 and/or one or more valves to selectively provide steam to the accessory. Additional functionality, e.g., to control various operational aspects of a steaming operation, to detect the attachment of an accessory to a removable fitting (e.g., to disable a steaming operation when no accessory is attached, etc., may also be supported.

Control module/panel 98 may be considered to be separate from controller 72 in some embodiments, while in other embodiments, control module/panel 98 may also be considered to be a component of controller 72. In other embodiments, no separate control module and/or panel may be used, and control over a hand held steaming accessory may be completely handled by controller 72. In still other embodiments, a hand held steaming accessory may be a fully separate system from the systems in appliance 70 devoted to the primary operational cycle(s) thereof.

Numerous additional variations and modifications to the cooking appliances illustrated in FIG. 3 will be apparent to one of ordinary skill in the art, as will become apparent from the description below. Therefore, the invention is not limited to the specific implementations discussed herein.

Figure 5:
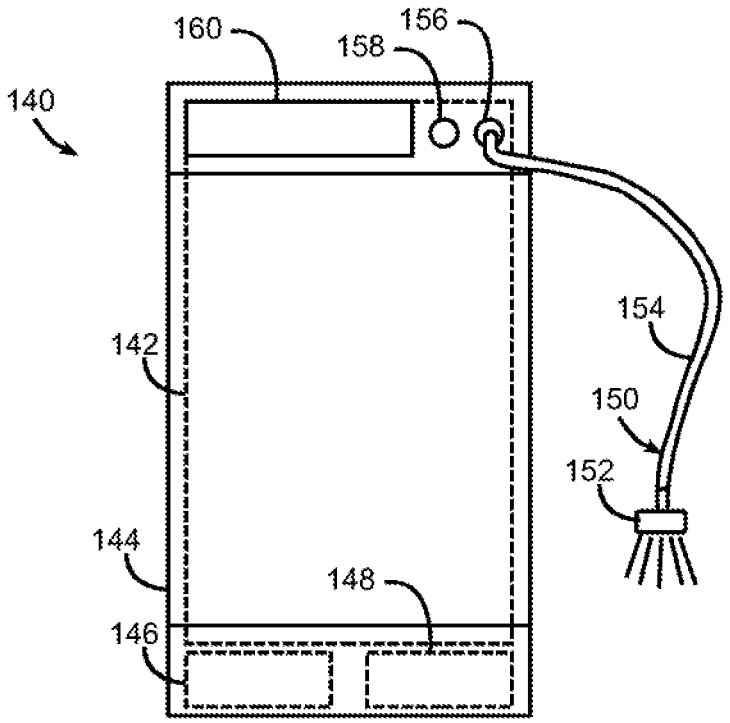
FIG. 5 is a functional front elevational view of a dishwasher consistent with some embodiments of the invention.

FIG. 5 next illustrates an example circuit diagram for an example laundry washing machine 100 incorporating a hand held steaming accessory consistent with the invention, with water or steam flow generally represented by a solid lines and electrical control signals generally represented by dashed lines. In this embodiment, only hot water flow is illustrated, although it will be appreciated that separate hot and cold water circuits may be used in some embodiments, while in other embodiments only a cold water circuit may be used, with heating elements in machine 100 used to heat the cold water as needed or desired.

Laundry washing machine 100 includes a hot water inlet 102 that couples to an external water line or supply 104, e.g., a residential water line. The pressurized water is supplied to a pair of valves 106, 108, the first of which regulates flow to a wash tub 110 for use in a wash cycle, and the second of which regulates flow to a steam generator 112. Steam generator 112 includes a water heater 114 that heats the water to generate steam, and may in some instances, include an internal tank to maintain a supply of pressurized, heated water. First and second outputs of steam generator 112 are regulated by a pair of valves 116, 118, the first of which outputs to wash tub 110 for use in a wash cycle, and the second of which outputs to a releasable fitting 120, which in turn communicates the steam to a hand held steam accessory 122. A controller 124 controls valves 106, 108, as well as water heater 114 and valves 116, 118 of steam generator 112, to regulate the flow of water and steam for use in primary operational cycles and/or steaming operations.

It will be appreciated that in this embodiment, steam generator 112 is used to supply steam for use in a primary operational cycle of machine 100. In instances where steam is not used in any primary operational cycles of machine 100, however, valve 116 may be omitted.

Now turning to FIGS. 5-8, while the discussion above has focus principally on the use of a hand held steam accessory for a laundry treatment machine such as a washer, dryer or combination washer/dryer, a hand held steam accessory may be used in connection with other major appliances. FIG. 5, for example, illustrates an example dishwasher 140, which includes a cabinet (wash tub 142), a door 144, a wash pump 146 for circulating water in the wash tub and serving as a major appliance component of dishwasher 140, and a steam generator 148. A hand held steam accessory 150 including a steam dispensing head 152 and flexible hose 154 is releasably and fluidly coupled to door 144 of dishwasher 140 through a releasable fitting 156 and is controlled by a control 158 that is separate from a control panel 160 of dishwasher 140, with fluid communication being provided between steam generator 148 and releasable fitting 156 through door 144. In some embodiments, steam generator 148 may also dispense steam to wash tub 142 for use during wash cycles.

Figure 6:
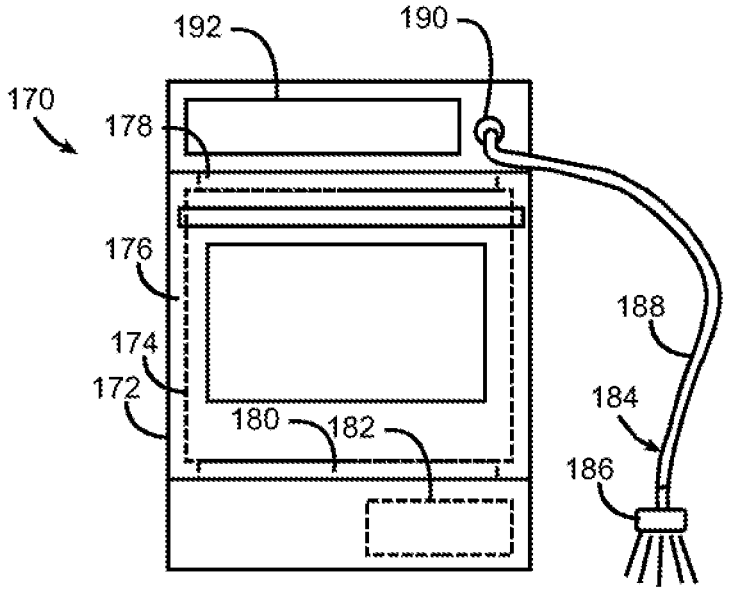
FIG. 6 is a functional front elevational view of an oven consistent with some embodiments of the invention.

FIG. 6, as another example, illustrates an example oven 170, which may be a wall-mounted oven or part of a slide-in or free-standing range. Oven 170 includes a cabinet 172 and an internal oven compartment 174 accessed using a door 176. Upper and lower cooking elements 178, 180 supply heat to oven 170 during a cooking cycle and thus serve as major appliance components for the oven. A steam generator 182 is provided in cabinet 172, and a hand held steam accessory 184 including a steam dispensing head 186 and flexible hose 188 is releasably and fluidly coupled to a releasable fitting 190 on cabinet 172. In this embodiment, no separate control panel or module is used to control steaming operations, and as such, a common control panel 192 is provided to control both steaming operations and the primary operational cycles of oven 170. It will be appreciated that in this embodiment, steam from steam generator 182 may only be provided for steaming operations, e.g., for surface cleaning operations that clean exterior and/or interior surfaces of the oven.

Figure 7:
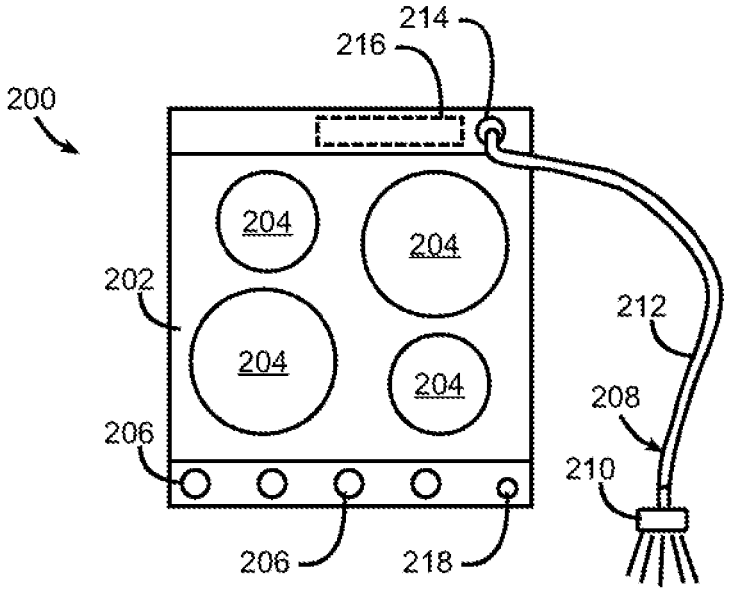
FIG. 7 is a functional top plan view of a cooktop consistent with some embodiments of the invention.

FIG. 7, as yet another example, illustrates another cooking appliance, a cooktop 200, which may be a drop-in cooktop or part of a slide-in or free-standing range. Cooktop 200 includes a cabinet or housing 202 supporting a number of cooktop burners 204 controlled by respective controls 206 to perform cooking cycles, and as such, serve as major appliance components for cooktop 200. A hand held steam accessory 208 including a steam dispensing head 210 and flexible hose 212 is releasably and fluidly coupled to a releasable fitting 214 on a rear portion of housing 202, which is in turn fluidly coupled to a steam generator 216 disposed in housing 202. A separate on/off control 218 is provided at a front of housing 202 to control steaming operations.

Figure 8:
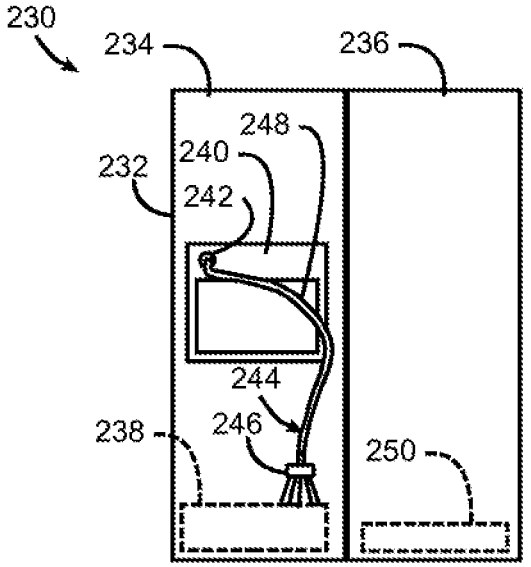
FIG. 8 is a functional front elevational view of a refrigerator consistent with some embodiments of the invention.

FIG. 8, as another example, illustrates a refrigerator 230 (here a side-by-side refrigerator), which includes a cabinet 232 covered by two doors 234, 236 and including a compressor 238 which serves as a major appliance component for refrigerator 230 by performing cooking cycles therefor. A control panel 240 on door 234 includes a releasable fitting 242, to which is releasably coupled a hand held steam accessory 244 including a steam dispensing head 246 and flexible hose 248. A steam generator 250 is fluidly coupled to hand held steam accessory 244, and control over steaming operations is handled through control panel 240.

A number of advantages may be obtained with some embodiments of the invention. For example, for major appliances already incorporating steam generators for use in primary operational cycles, the inclusion of a hand held steam accessory may provide added utility for such appliances at a relatively low cost, and generally with higher performance (e.g., faster startup and/or an unending supply of steam) than is generally obtained with many portable or hand held steaming appliances. Further, in some embodiments, steaming operations may be used for cleaning surfaces of the appliances themselves and/or providing additional functionality to such appliances.

It will be appreciated that a hand held steaming accessory may be used in connection with other major appliances than those described specifically herein, and moreover, the locations of steam generators, water supply systems therefor, storage compartments and releasable fittings within different appliances may vary considerably in different embodiments. Various additional modifications may be made to the illustrated embodiments consistent with the invention. Therefore, the invention lies in the claims hereinafter appended.

What is claimed is:

1. A laundry treatment machine, comprising:

a cabinet including a top-mounted door and a backsplash positioned rearwardly of the door and projecting above a surface of the door;

a water inlet coupled to the cabinet and configured to fluidly couple to an external water supply;

a vertically-oriented rotatable drum disposed within the cabinet and accessible through the top-mounted door;

a drive system configured to rotate the drum;

a steam generator disposed within the cabinet, the steam generator fluidly coupled to the water inlet;

a hand held steam accessory including a steam dispensing head and a flexible hose fluidly coupled to the steam generator, the hand held steam accessory configured to be manually operated to perform a steaming operation external to the cabinet; and a controller coupled to the drive system and the steam generator, the controller configured to control the drive system during a primary laundry treatment cycle, to selectively actuate the steam generator to generate steam for use in the primary laundry treatment cycle, and to selectively actuate the steam generator to generate steam for use in the steaming operation with the hand held steam accessory;

wherein the cabinet includes an accessory storage compartment accessible through the backsplash for use in storing the hand held steam accessory.

2. The laundry treatment machine of claim 1, wherein the primary laundry treatment cycle is a wash cycle.

3. The laundry treatment machine of claim 1, wherein the primary laundry treatment cycle is a dry cycle.

4. A major appliance, comprising:

a cabinet including a top-mounted door and a backsplash positioned rearwardly of the door and projecting above a surface of the door;

a major appliance component;

a vertically-oriented rotatable drum disposed within the cabinet and accessible through the top-mounted door;

a steam generator disposed within the cabinet, the steam generator configured to fluidly couple to a water supply;

a controller coupled to the major appliance component and the steam generator, the controller configured to control the major appliance component to perform a primary operational cycle of the major appliance, the controller further configured to selectively actuate the steam generator to generate steam; and a hand held steam accessory fluidly coupled to the steam generator and configured to be manually operated to perform a steaming operation external to the cabinet, wherein the hand held steam accessory includes a flexible hose and a steam dispensing head coupled to the flexible hose, and wherein the cabinet includes an accessory storage compartment accessible through the backsplash for use in storing the hand held steam accessory.

5. The major appliance of claim 4, wherein the major appliance is a laundry washing machine that includes a wash tub, wherein the rotatable drum is disposed in the wash tub, wherein the major appliance component includes a drive system configured to rotate the drum, and wherein the primary operational cycle of the major appliance is a wash cycle.

6. The major appliance of claim 4, wherein the major appliance is a laundry dryer, wherein the major appliance component includes a drive system configured to rotate the drum, and wherein the primary operational cycle of the major appliance is a dry cycle.

7. The major appliance of claim 4, wherein the steam generator includes first and second outputs, the first output fluidly coupled to the hand held steam accessory, and the second output configured to output steam for use in the primary operational cycle of the major appliance, and wherein the controller is further configured to selectively actuate the steam generator to supply steam from the second output during the primary operational cycle of the major appliance.

8. The major appliance of claim 7, wherein the major appliance is a laundry treatment appliance, wherein the controller is configured to selectively actuate the steam generator to steam laundry disposed within the cabinet, and wherein the steaming operation is an external laundry treatment operation.

9. The major appliance of claim 4, wherein the steaming operation is a surface cleaning operation for cleaning a surface of the major appliance.

10. The major appliance of claim 4, wherein the flexible hose is retractable into the accessory storage compartment.

11. The major appliance of claim 4, wherein the flexible hose is fluidly coupled to the steam generator through a releasable fitting such that the flexible hose is detachable from the releasable fitting.

12. The major appliance of claim 4, further comprising a control panel, the control panel including a plurality of user controls, a first subset of the plurality of controls configured to control the controller to perform the primary operational cycle of the major appliance, and a second subset of the plurality of controls configured to control the controller to actuate the steam generator to supply steam to the hand held steam accessory.

13. The major appliance of claim 4, further comprising a water inlet configured to couple to a residential water supply and a valve coupled intermediate the water inlet and the steam generator to control water flow to the steam generator.

* * * * *